United States Patent [19]

Asaeda et al.

[11] 4,446,657

[45] May 8, 1984

[54] RESINOID BONDED GRINDING WHEEL AND METHOD FOR FORMING SUCH WHEEL

[75] Inventors: Toshio Asaeda, Tokyo; Ikuo Suzuki, Chiryu; Tomoyasu Imai, Kariya; Masato Kitajima, Hekinan, all of Japan

[73] Assignees: Toyoda Koki Kabushiki Kaisha, Kariya; Toshio Asaeda, Tokyo, both of Japan

[21] Appl. No.: 271,997

[22] Filed: Jun. 9, 1981

[30] Foreign Application Priority Data

Jun. 13, 1980 [JP] Japan ..... 55-83616[U]

[51] Int. Cl.[3] ..... B24D 5/04

[52] U.S. Cl. ..... 51/206 R; 51/295; 51/298; 51/307

[58] Field of Search ..... 51/206 R, 295, 298, 51/307

[56] References Cited

U.S. PATENT DOCUMENTS 3,686,800 8/1972 Rue et al. ..... 51/206 R 3,756,796 9/1973 Miller ..... 51/206 R X 3,986,847 10/1976 Balson ..... 51/307 X 4,099,934 7/1978 Suzuki et al. ..... 51/295

4,099,934 7/1976 Suzuki et al. .

*Primary Examiner*—Frank T. Yost

*Assistant Examiner*—Willmon Fridie, Jr.

*Attorney, Agent, or Firm*—Oblon, Fisher, Spivak, McClelland & Maier

[57] ABSTRACT

A resinoid-bonded grinding wheel employing hard abrasives such as cubic boron nitride or diamond is formed with a support member made of a vitrified grinding wheel. The support member has sealing layers on the surfaces thereof for avoiding the penetration of coolant into the support member. A method for forming the wheel includes mounting a grinding element on a radial peripheral surface portion of the support member and applying a sealing layer to the remaining surface portions of the grinding element for preventing penetration of the coolant into the support member and generation of vibrations in the grinding wheel during operation due to rotational imbalance caused by the presence of coolant within the support member.

18 Claims, 2 Drawing Figures

RESINOID BONDED GRINDING WHEEL AND METHOD FOR FORMING SUCH WHEEL

BACKGROUND OF THE INVENTION

1. Field of the Invention

The present invention relates to a resinoid bonded grinding wheel and method for forming the same which has hard abrasives, such as diamond or cubic boron nitride, bonded on a support member which is made of porous ceramics, such as, for example, a vitrified grinding wheel.

2. Description of the Prior Art

A prior resinoid bonded grinding wheel is known which is provided with a support member to which is affixed grinding element including a diamond or cubic boron nitride abrasives distributed in a bonding matrix. In general, since the support member is made of a metallic material, such as aluminum-base alloy, which has a relatively high thermal conductivity and a high coefficient of thermal expansion, the grinding wheel is caused to expand by heat transmitted from bearing members and the grinding area between the grinding element and a workpiece, thereby resulting in inaccurate grinding.

In order to solve these disadvantages, it has been considered to utilize a resinoid bonded grinding wheel having a support member which is made of porous ceramics such as a vitrified grinding wheel which contains alumina or silicon carbide abrasives bonded by a vitrified bonding matrix. The thermal conductivity and the coefficient of thermal expansion of the vitrified grinding wheel are advantageously so low that it is effective in preventing the resulting heat during use from being transmitted to the entire body of the support member and to avoid thermal expansion of the support member. However, since the support member is porous and the grinding element affixed thereto is impervious to water, a liquid lubricant or coolant penetrates into the support member. Such penetration may cause a weight imbalance of the grinding wheel. Particularly, in the case of a grinding wheel having two conical grinding surfaces on the outer periphery thereof as shown in FIG. 2, the coolant penetrates into the support member and is accummulated in the inside corner between the two conical grinding surfaces during rotation of the support member, because it cannot be discharged through the grinding element.

When the grinding wheel is rotating, weight imbalance thereof does not occur. However, when rotation of the grinding wheel is discontinued, the coolant which has penetrated into the support member starts to flow downwardly due to the effect of gravity and is accumulated in the bottom part of the support member to thereby cause weight imbalance of the grinding wheel. Therefore, when the rotation of the grinding wheel is restarted, the weight imbalance generates a corresponding vibration during the grinding operation, thereby causing inaccurate grinding results. Furthermore, even in the situation where a straight-type grinding wheel is utilized which has a cylindical grinding surface, weight imbalance of the grinding wheel may occur because the coolant cannot be discharged through the grinding element thereof.

SUMMARY OF THE INVENTION

It is therefore an object of the present invention to provide a new and improved grinding wheel and method for forming the wheel having a support member which has a sealing effect to avoid penetration of a coolant into the support member for maintaining precision grinding operation.

Briefly, according to the present invention, these and other objects are achieved by providing a grinding wheel for use in a grinding machine, as mentioned below. A grinding element having hard grain elements such as diamond or cubic boron nitride distributed in a resinoid bonding matrix is utilized. A support member made of porous ceramics for mounting thereon the grinding element is also utilized along with a sealing layer formed on the surface of the support member for avoiding penetration of coolant into the support member.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

Figure 1:
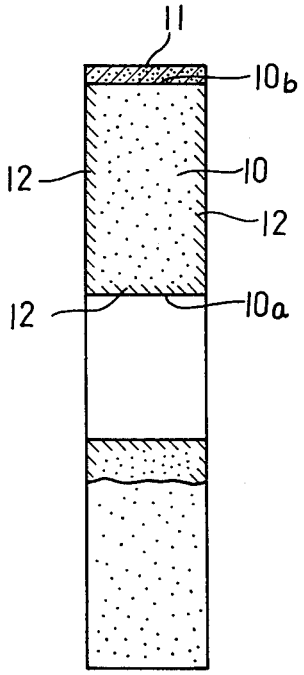
FIG. 1 is a view, partly in section, of a grinding wheel according to a first embodiment of the present invention for a straight-type grinding machine.

Referring now to the drawings, there is shown a circular support member 10 made of a porous ceramics such as a vitrified grinding wheel. Support 10 is formed with a bore 10*a* at the center thereof to be mounted on a grinding machine. Formed on the outer periphery of support member 10 in the embodiment shown in FIG. 1 is a cylindical surface 10*b* which is parallel to the axis of the support member 10. A grinding element 11 is affixed to support member 10 and contains hard abrasives such as diamond or cubic boron nitride bonded by a resinoid bonding matrix mainly containing a synthetic resin such as a phenolic resin.

Figure 2:
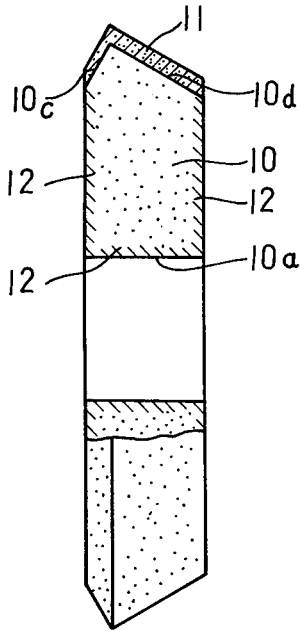
FIG. 2 is a view, partly in section, of a grinding wheel according to a second embodiment of the present invention for an angular-type grinding machine.

FIG. 2 shows a second embodiment of the present invention, wherein two conical surfaces 10*c*, 10*d* are formed on the outer periphery of the support member 10. Grinding elements 11 as shown in FIGS. 1 and 2 may be formed on support member 10 by press-forming the mixture of the hard abrasives and a powdered thermosetting phenol resin upon the surface of support member 10 and then thermally setting the same by heating. Such method is disclosed in U.S. Pat. No. 4,099,934. The mixture may contain fillers such as graphite, aluminum oxide grain or silicon carbide grain to improve the strength or the physical properties of the resinoid bonding matrix.

Reference numeral 12 denotes sealing layers formed on the side surfaces of support member 10 and on the cylindical surface of bore 10*a* thereof for avoiding penetration of a coolant into support member 10 made of the porous ceramics. The method of forming sealing layers 12 on support member 10 may include the following steps: (a) applying a liquid thermosetting resin such as a liquid thermosetting phenol or epoxy resin to the surfaces of support member 10 so as to cause the same to penetrate thereinto and (b) heating support member 10 so as to thermally set the resin on the surfaces thereof. The thermosetting phenol resin is thermally set at about 180° C.

Other methods for forming the sealing layers 12 on support member 10, include for example, forming the same by painting the surfaces of support member 10 with a paint such as a vinyl chloride resin paint or by sticking sheets made of impervious materials such as plastic, polytetrafluoroethylene or phenolic resin on such surfaces.

In the above-described embodiments, sealing layer 12 is formed on the side surfaces of support member 10 and the cylindical surface of bore 10*a* to avoid penetration of the coolant into support member 10 made of porous ceramics. Accordingly, rotational imbalance of the grinding wheel due to the accumulation of the coolant is avoided in both of the grinding wheels shown in FIGS. 1 and 2. Therefore, the grinding wheel according to the present invention is capable of maintaining precision grinding operation, even after discontinuation of the rotation of the grinding wheel for a period of time.

Obviously, numerous modifications and variations of the present invention are possible in light of the above teachings. It is to be understood, therefore, that within the scope of the appended claims, the invention may be practiced otherwise than as specifically described herein.

What is claimed as new and desired to be secured by Letters Patent of the United States is:

1. A grinding wheel for use in a grinding machine which utilizes coolant during operation, said grinding wheel comprising:

(a) a support member made of porous ceramic;

(b) a grinding element mounted on said support member and constituting the working surface of said grinding wheel, said grinding element including hard grain elements distributed in a resinoid bonding matrix; and (c) a coolant-impervious sealing layer formed on every surface of said support member except the surface on which said grinding element is mounted, said sealing layer preventing penetration of coolant into said support member, whereby generation of vibrations due to imbalance of said support member caused by the presence of coolant in said support member during rotation of said grinding wheel is avoided.

2. A grinding wheel as recited in claim 1 wherein said support member is vitrified.

3. A grinding wheel as recited in claim 1 wherein said sealing layer is formed from a thermosetting resin.

4. A grinding wheel as recited in claim 3 wherein said thermosetting resin is an epoxy resin or a thermosetting phenol.

5. A grinding wheel as recited in claim 1 wherein said sealing layer comprises a paint applied to the surface of said support member.

6. A grinding wheel as recited in claim 5 wherein said paint is a vinyl chloride resin paint.

7. A grinding wheel as recited in claim 1 wherein said sealing layer comprises an impervious sheet applied to the surface of said support member.

8. A grinding wheel as recited in claim 7 wherein said impervious sheet is composed of plastic, polytetrafluoroethylene, or phenolic resin.

9. A grinding wheel as recited in claim 1 wherein:

(a) said support member has a bore formed therein for mounting the grinding wheel on the grinding machine;

(b) said support member has an axially extending cylindrical surface defining said bore, first and second radially extending side surfaces, and a circumferential surface on which said grinding element is mounted; and (c) said sealing layer is formed on said axially extending cylindrical surface and said first and second radially extending side surfaces.

10. A grinding wheel for use in a grinding machine which utilizes coolant during operation, said grinding wheel comprising:

(a) a support member made of porous ceramic, said support member having an axially extending cylindrical surface defining a bore for mounting said grinding wheel on the grinding machine, first and second radially extending side surfaces, and a circumferential surface;

(b) a grinding element mounted on the circumferential surface of said support member and constituting the working surface of said grinding wheel, said grinding element including hard grain elements distributed in a resinoid bonding matrix; and (c) a sealing layer formed on said axially extending cylindrical surface and said radially extending side surfaces of said support member, said sealing layer preventing penetration of coolant into said support member, whereby generation of vibration due to imbalance of said support member caused by the presence of coolant in said support member during rotation of said grinding wheel is avoided.

11. A method of preventing the penetration of coolant into a porous ceramic support member of a grinding wheel and thereby avoiding the generation of vibrations due to imbalance caused by the presence of such coolant in the support member, said method comprising the steps of:

(a) mounting a grinding element on said support member, said grinding element including hard grain elements distributed in a resinoid bonding matrix and constituting the working surface of said grinding wheel, and (b) applying a coolant impervious sealing layer on every surface of said support member except the surface thereof on which said grinding element is mounted.

12. A method as set forth in claim 11, in which said steps of applying a coolant impervious sealing layer comprises:

applying a liquid thermosetting resin to the surfaces of said support member, and heating said support member to thermally set said resin on the surfaces thereof.

13. A method as set forth in claim 12 wherein said liquid thermosetting resin is an epoxy resin.

14. A method as set forth in claim 12, wherein said liquid thermosetting resin is a phenolic resin.

15. A method as set forth in claim 11, wherein the step of applying a coolant impervious sealing layer comprises:

painting said surface of said support member with a vinyl chloride resin paint.

16. A method as set forth in claim 11, wherein the step of applying a coolant impervious sealing layer comprises:

adhering a polytetrafluoroethylene sheet to said surface of said support member.

17. A method as set forth in claim 11, wherein the step of applying a coolant impervious sealing layer comprises:

adhering a phenolic resin sheet to said surface of said support member.

18. A method as set forth in claim 11, wherein the step of applying a coolant impervious sealing layer comprises:

adhering a plastic sheet to said surface of said support member.

* * * * *